US005890671A

United States Patent [19]

Meloy

[11] Patent Number: 5,890,671

[45] Date of Patent: Apr. 6, 1999

[54] WINCH ATTACHMENT FOR VEHICLES

[76] Inventor: Ronald E. Meloy, 11315 Greenwood Rd., Kansas City, Mo. 64134

[21] Appl. No.: 31,475

[22] Filed: Feb. 26, 1998

[51] Int. Cl.[6] ..... B65H 75/40

[52] U.S. Cl. ..... 242/392; 254/323; 254/328

[58] Field of Search ..... 242/392; 254/323, 254/325, 328; 180/7.5, 53.61

[56] References Cited

U.S. PATENT DOCUMENTS

| | | |
|---|---|---|
| 766,580 | 8/1904 | Baker . |
| 1,522,424 | 1/1925 | De Lano . |
| 2,642,235 | 6/1953 | Smith . |
| 3,784,164 | 1/1974 | Blum . |
| 3,917,228 | 11/1975 | Blum . |
| 4,742,971 | 5/1988 | Wallace et al. . |
| 4,778,126 | 10/1988 | Spann, Jr. . |
| 5,115,994 | 5/1992 | Hershberger . |

*Primary Examiner*—Donald P. Walsh
*Assistant Examiner*—William A. Rivera

[57] ABSTRACT

A winch attachment for vehicles for aiding in freeing a vehicle that is stuck. The device includes eight tow forks adapted for coupling with a pair of opposed tires of a vehicle, four of the tow forks for each tire. Each of the tow forks have a generally L-shaped configuration. Inner ends of the tow forks have socket adapters disposed thereon for engaging lug nuts of the tires. Outer ends of the tow forks have an elongated slot formed therethrough. The elongated slots of each of the four tow forks are in alignment with one another for receiving a bolt therethrough. The bolt is engaged by a wingnut. A pair of long straps are securable to one of the tow forks of the opposed tires of the vehicle. Outer ends of the long straps have an aperture therethrough. A pair of anchor bars are received through the apertures of the long straps for securement within a recipient surface.

7 Claims, 2 Drawing Sheets

WINCH ATTACHMENT FOR VEHICLES

BACKGROUND OF THE INVENTION

1. Field of the Invention

The present invention relates to winches and more particularly pertains to a new winch attachment for vehicles for aiding in freeing a vehicle that is stuck.

2. Description of the Prior Art

The use of winches is known in the prior art. More specifically, winches heretofore devised and utilized are known to consist basically of familiar, expected and obvious structural configurations, notwithstanding the myriad of designs encompassed by the crowded prior art which have been developed for the fulfillment of countless objectives and requirements.

Known prior art winches include U.S. Pat. No. 5,115,994 to Hershberger; U.S. Pat. No. 3,917,228 to Blum; U.S. Pat. No. 4,836,466 to Peterson; U.S. Pat. No. 5,054,745 to Swayze et al.; U.S. Pat. No. 4,742,971 to Wallace et al.; and U.S. Pat. No. Des. 356,538 to Botterman.

While these devices fulfill their respective, particular objectives and requirements, the aforementioned patents do not disclose a new winch attachment for vehicles. The inventive device includes eight tow forks adapted for coupling with a pair of opposed tires of a vehicle, four of the tow forks for each tire. Each of the tow forks have a generally L-shaped configuration. Inner ends of the tow forks have socket adapters disposed thereon for engaging lug nuts of the tires. Outer ends of the tow forks have an elongated slot formed therethrough. The elongated slots of each of the four tow forks are in alignment with one another for receiving a bolt therethrough. The bolt is engaged by a wingnut. A pair of long straps are securable to one of the tow forks of the opposed tires of the vehicle. Outer ends of the long straps have an aperture therethrough. A pair of anchor bars are received through the apertures of the long straps for securement within a recipient surface.

In these respects, the winch attachment for vehicles according to the present invention substantially departs from the conventional concepts and designs of the prior art, and in so doing provides an apparatus primarily developed for the purpose of aiding in freeing a vehicle that is stuck.

SUMMARY OF THE INVENTION

In view of the foregoing disadvantages inherent in the known types of winches now present in the prior art, the present invention provides a new winch attachment for vehicles construction wherein the same can be utilized for aiding in freeing a vehicle that is stuck.

The general purpose of the present invention, which will be described subsequently in greater detail, is to provide a new winch attachment for vehicles apparatus and method which has many of the advantages of the winches mentioned heretofore and many novel features that result in a new winch attachment for vehicles which is not anticipated, rendered obvious, suggested, or even implied by any of the prior art winches, either alone or in any combination thereof.

To attain this, the present invention generally comprises eight tow forks adapted for coupling with a pair of opposed tires of a vehicle, four of the tow forks for each tire. Each tire includes an upper tow fork, a lower tow fork and a pair of side tow forks. The tow forks for each tire are disposed at ninety degree intervals. Each of the tow forks have a generally L-shaped configuration. Inner ends of the tow forks have socket adapters disposed thereon for engaging lug nuts of the tires. Outer ends of the tow forks have an elongated slot formed therethrough. The elongated slots of each of the four tow forks are in alignment with one another for receiving a bolt therethrough. The bolt is engaged by a wingnut. The upper and lower tow forks each have a tab extending outwardly therefrom adjacent to a bend therein. A pair of long straps are securable to the lower tow forks of the opposed tires of the vehicle. The pair of long straps include a looped inner end for coupling with the lower tow forks. Outer ends of the long straps have an aperture therethrough. A pair of anchor bars are provided with each having a generally L-shaped configuration. Each of the anchor bars have an elongated vertical portion and a short horizontal portion. A free end of the elongated vertical portion is tapered for penetrating a recipient surface. The free ends are received through the apertures of the long straps for securement within the recipient surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new winch attachment for vehicles apparatus and method which has many of the advantages of the winches mentioned heretofore and many novel features that result in a new winch attachment for vehicles which is not anticipated, rendered obvious, suggested, or even implied by any of the prior art winches, either alone or in any combination thereof.

It is another object of the present invention to provide a new winch attachment for vehicles which may be easily and efficiently manufactured and marketed.

It is a further object of the present invention to provide a new winch attachment for vehicles which is of a durable and reliable construction.

An even further object of the present invention is to provide a new winch attachment for vehicles which is susceptible of a low cost of manufacture with regard to both materials and labor, and which accordingly is then susceptible of low prices of sale to the consuming public, thereby making such winch attachment for vehicles economically available to the buying public.

Still yet another object of the present invention is to provide a new winch attachment for vehicles which provides in the apparatuses and methods of the prior art some of the advantages thereof, while simultaneously overcoming some of the disadvantages normally associated therewith.

Still another object of the present invention is to provide a new winch attachment for vehicles for aiding in freeing a vehicle that is stuck.

Yet another object of the present invention is to provide a new winch attachment for vehicles which includes eight tow forks adapted for coupling with a pair of opposed tires of a vehicle, four of the tow forks for each tire. Each of the tow forks have a generally L-shaped configuration. Inner ends of the tow forks have socket adapters disposed thereon for engaging lug nuts of the tires. Outer ends of the tow forks have an elongated slot formed therethrough. The elongated slots of each of the four tow forks are in alignment with one another for receiving a bolt therethrough. The bolt is engaged by a wingnut. A pair of long straps are securable to one of the tow forks of the opposed tires of the vehicle. Outer ends of the long straps have an aperture therethrough. A pair of anchor bars are received through the apertures of the long straps for securement within a recipient surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
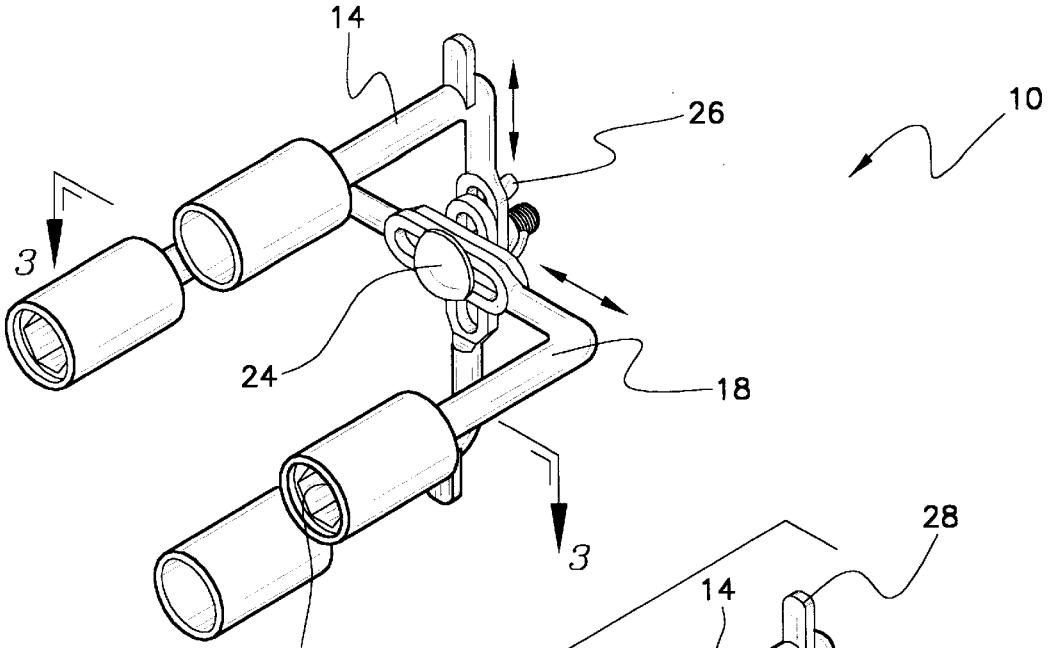
FIG. 1 is a perspective view of a new winch attachment for vehicles according to the present invention.
Figure 2:
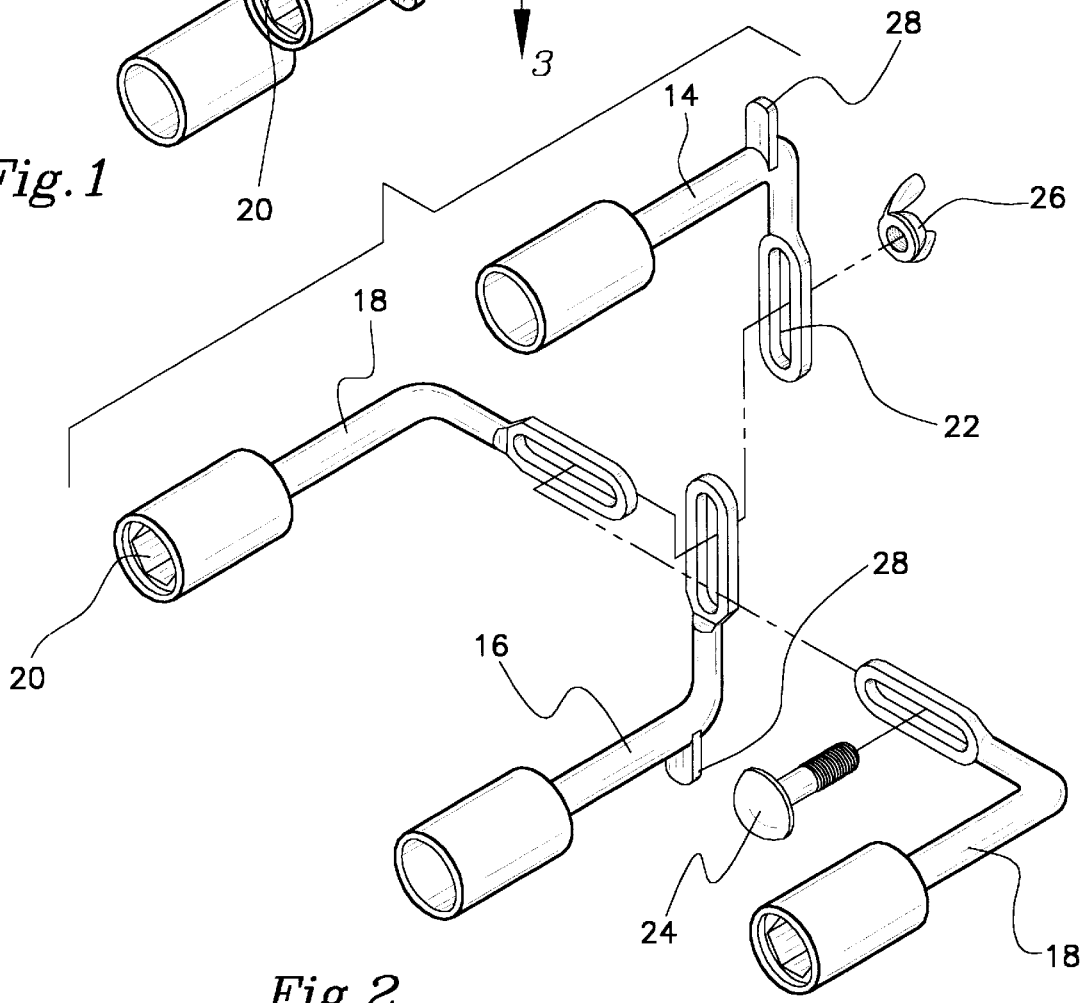
FIG. 2 is an exploded perspective view of the present invention.
Figure 3:
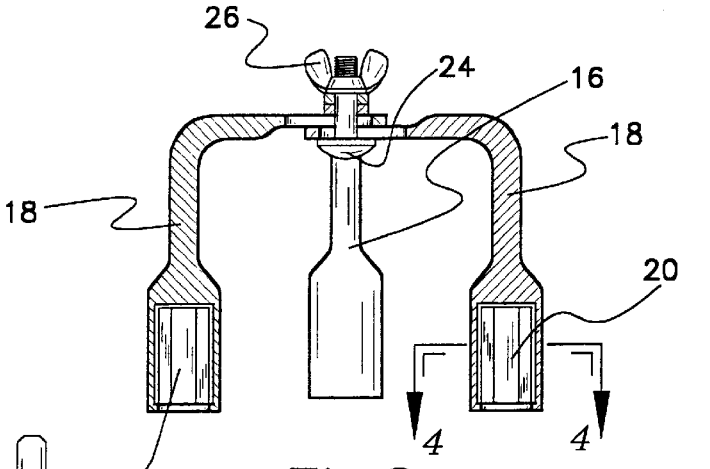
FIG. 3 is a top plan view of the present invention.
Figure 4:
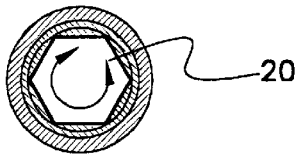
FIG. 4 is a cross-sectional view of the present invention as taken along line 4—4 of FIG. 3.
Figure 5:
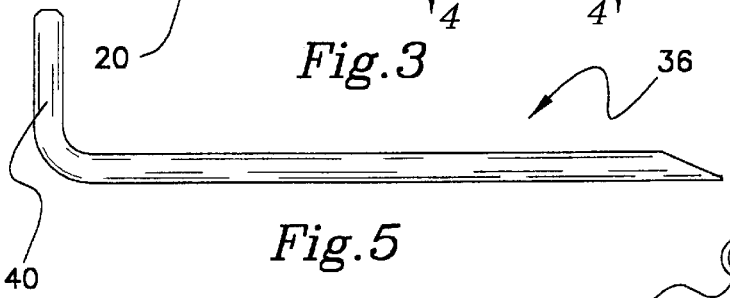
FIG. 5 is a side view of the anchor bar of the present invention.
Figure 6:
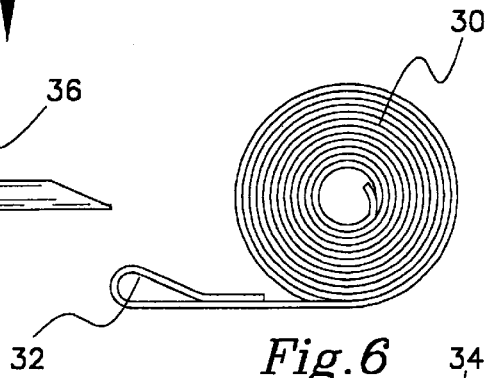
FIG. 6 is a side view of the long strap of the present invention.
Figure 7:
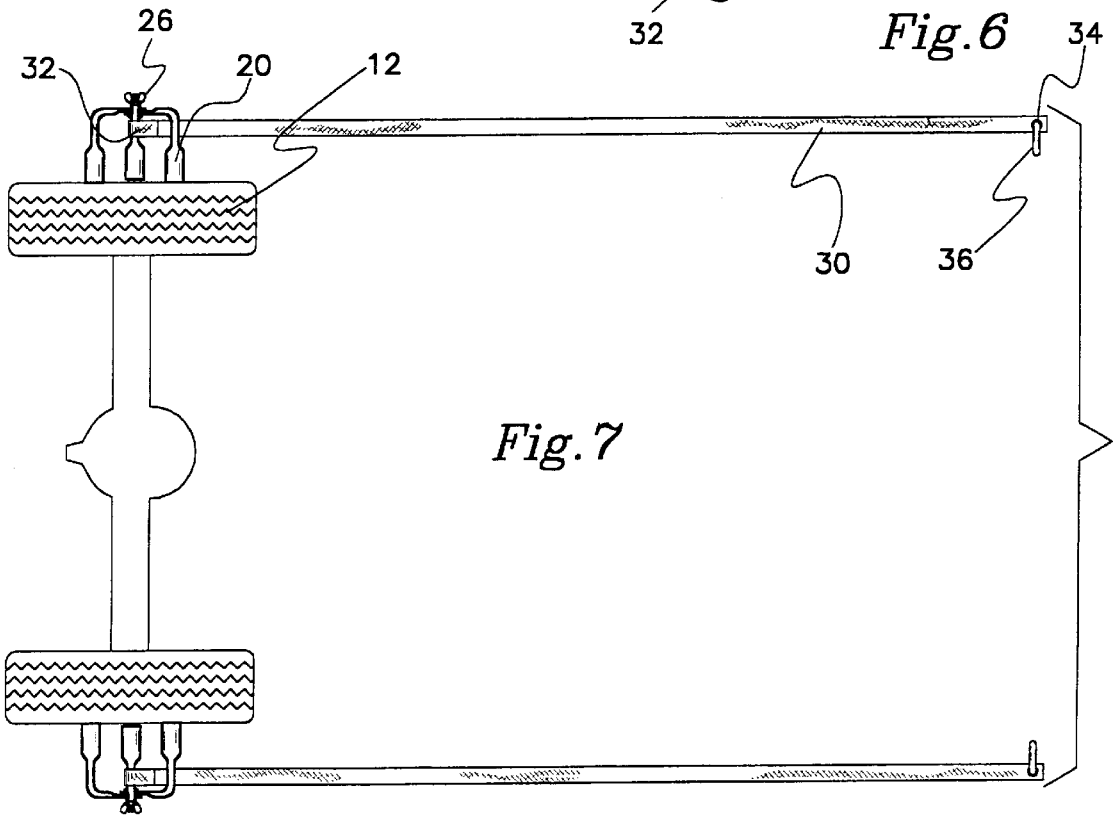
FIG. 7 is a plan view of the present invention illustrated in use.

With reference now to the drawings, and in particular to FIGS. 1 through 7 thereof, a new winch attachment for vehicles embodying the principles and concepts of the present invention and generally designated by the reference numeral 10 will be described.

As best illustrated in FIGS. 1 through 7, the winch attachment for vehicles 10 comprises eight tow forks adapted for coupling with a pair of opposed tires 12 of a vehicle, four of the tow forks for each tire. Each tire 12 includes an upper tow fork 14, a lower tow fork 16 and a pair of side tow forks 18. The tow forks for each tire 12 are disposed at ninety degree intervals. Each of the tow forks have a generally L-shaped configuration. Inner ends of the tow forks have socket adapters 20 disposed thereon for engaging lug nuts of the tires 12. Outer ends of the tow forks have an elongated slot 22 formed therethrough. The elongated slots 22 of each of the four tow forks are in alignment with one another for receiving a bolt 24 therethrough. The bolt 24 is engaged by a wingnut 26. The upper 14 and lower tow forks 16 each have a tab 28 extending outwardly therefrom adjacent to a bend therein.

A pair of long straps 30 are securable to the lower tow forks 16 of the opposed tires 12 of the vehicle. The pair of long straps 30 include a looped inner end 32 for coupling with the lower tow forks 16. The tab 28 will prevent the straps 30 from becoming disengaged from the tow fork. The straps 30 could be secured to the upper tow forks 14 as well. Outer ends of the long straps 30 have an aperture 34 therethrough.

A pair of anchor bars 36 are provided with each having a generally L-shaped configuration. Each of the anchor bars 36 have an elongated vertical portion 38 and a short horizontal portion 40. A free end of the elongated vertical portion 38 is tapered for penetrating a recipient surface. The free ends are received through the apertures 34 of the long straps 30 for securement within the recipient surface.

In use, when a vehicle has been stuck in mud, snow, ice, etc., the present invention will help free a vehicle from such impediment. The user would simply place the tow forks on the stuck drive wheels, extend the straps 30 forward or backward along the vehicle, depending on which direction of travel seemed more likely to result in the easy freeing of the vehicle, and drive the anchor bars 36 into the ground. As the drive wheels started to turn, the straps 30 would wind onto something like cables winding onto winches. In the process, the vehicle would hopefully be pulled out of its position and freed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A winch attachment for vehicles for aiding in freeing a vehicle that is stuck comprising, in combination:

eight tow forks adapted for coupling with a pair of opposed tires of a vehicle, four of the tow forks for each tire, each tire including an upper tow fork, a lower tow fork and a pair of side tow forks, the tow forks for each tire being disposed at ninety degree intervals, each of the tow forks having a generally L-shaped configuration, inner ends of the tow forks having socket adapters disposed thereon for engaging lug nuts of the tires, outer ends of the tow forks having an elongated slot formed therethrough, the elongated slots of each of the four tow forks being in alignment with one another for receiving a bolt therethrough, the bolt being engaged by a wingnut, the upper and lower tow forks each having a tab extending outwardly therefrom adjacent to a bend therein;

a pair of long straps securable to the lower tow forks of the opposed tires of the vehicle, the pair of long straps including a looped inner end for coupling with the lower tow forks, outer ends of the long straps having an aperture therethrough; and a pair of anchor bars each having a generally L-shaped configuration, each of the anchor bars having an elongated vertical portion and a short horizontal portion, a free end of the elongated vertical portion being tapered for penetrating a recipient surface, the free ends being received through the apertures of the long straps for securement within the recipient surface.

2. A winch attachment for vehicles for aiding in freeing a vehicle that is stuck comprising, in combination:

eight tow forks adapted for coupling with a pair of opposed tires of a vehicle, four of the tow forks for each tire, each of the tow forks having a generally L-shaped configuration, inner ends of the tow forks having socket adapters disposed thereon for engaging lug nuts of the tires, outer ends of the tow forks having an elongated slot formed therethrough, the elongated slots of each of the four tow forks being in alignment with one another for receiving a bolt therethrough, the bolt being engaged by a wingnut;

a pair of long straps securable to one of the tow forks of the opposed tires of the vehicle, outer ends of the long straps having an aperture therethrough; and a pair of anchor bars being received through the apertures of the long straps for securement within a recipient surface.

3. The winch attachment for vehicles as set forth in claim 2 wherein each tire includes an upper tow fork, a lower tow fork and a pair of side tow forks.

4. The winch attachment for vehicles as set forth in claim 3 wherein the tow forks for each tire are disposed at ninety degree intervals.

5. The winch attachment for vehicles as set forth in claim 3 wherein the upper and lower tow forks each have a tab extending outwardly therefrom adjacent to a bend therein.

6. The winch attachment for vehicles as set forth in claim 2 wherein the pair of long straps include a looped inner end for coupling with the lower tow forks.

7. The winch attachment for vehicles as set forth in claim 2 wherein the pair of anchor bars each have a generally L-shaped configuration, each of the anchor bars having an elongated vertical portion and a short horizontal portion, a free end of the elongated vertical portion being tapered for penetrating the recipient surface, the free ends being received through the apertures of the long straps for securement within the recipient surface.

* * * * *